US006685506B1

(12) United States Patent
Nakamura et al.

(10) Patent No.: US 6,685,506 B1
(45) Date of Patent: Feb. 3, 2004

(54) CONNECTOR AND A METHOD FOR CONNECTING SUCH CONNECTOR WITH A MATING CONNECTOR

(75) Inventors: Hideto Nakamura, Yokkaichi (JP); Takeshi Tsuji, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/212,282

(22) Filed: Aug. 1, 2002

(30) Foreign Application Priority Data

Aug. 3, 2001 (JP) ..... 2001-236353

(51) Int. Cl.[7] ..... H01R 13/422
(52) U.S. Cl. ..... 439/595
(58) Field of Search ..... 439/595, 752, 439/152, 159, 381

(56) References Cited

U.S. PATENT DOCUMENTS 5,167,534 A 12/1992 Ohsumi ..... 439/595
5,658,168 A * 8/1997 Myer et al. ..... 439/595
5,722,857 A * 3/1998 Saito et al. ..... 439/595
5,730,626 A * 3/1998 Tomita et al. ..... 439/595
5,842,884 A * 12/1998 Maegawa et al. ..... 439/595
5,944,558 A * 8/1999 Iwahori ..... 439/595
6,048,226 A * 4/2000 Iwahori ..... 439/595

* cited by examiner

*Primary Examiner*—Gary Paumen
(74) *Attorney, Agent, or Firm*—Anthony J. Casella; Gerald E. Hespos

(57) ABSTRACT

A connector has a housing (20) with a receptacle (22) and locks (24) for engaging male terminal fittings (10) in the housing (20). A retainer (30) is mounted in the receptacle (22) and has a preventing plate (31) that projects into a deformation permitting spaces (25) for preventing resilient deformation of locks (24) and doubly locking the terminal fittings (10) in the housing (20). A mating housing (60) can be fit into the receptacle (22) and pushes the retainer (30) back to a pushed-in position while resiliently compressing a spring (43). When the housing (60) is withdrawn from the receptacle (22), the retainer (30) is pushed back by a resilient restoring force of the spring (43). During this time, insertion holes (32) of the retainer (30) move along tabs (12) of the terminal fittings (10) for automatically correcting misalignment.

19 Claims, 9 Drawing Sheets

CONNECTOR AND A METHOD FOR CONNECTING SUCH CONNECTOR WITH A MATING CONNECTOR

BACKGROUND OF THE INVENTION

1. Field of the Invention

The invention relates to a connector into which terminal fittings are inserted and to a method for connecting a connector with a mating connector.

2. Description of the Related Art

U.S. Pat. No. 5,167,534 discloses a male connector that has a male housing with a main body. A receptacle is formed on the front surface of the main body, and cavities are formed in the main body. Male terminal fittings are accommodated in the cavities, and tabs at the leading ends of the male terminal fittings project into the receptacle. A retainer locks the male terminal fittings in the cavities. A mating connector with female terminal fittings can be inserted into the receptacle to connect the male and female terminal fittings.

The male and female connectors of the above-described assembly may be detached for maintenance. However, the tabs that project into the receptacle of the male connector may become misaligned if the female connector is pulled out of the receptacle forcibly. As a result, the connectors may not mate smoothly during a subsequent reconnection and, in an extreme case, the female terminal fittings may strike against and bend the tabs.

The present invention was developed in view of the above problem and an object thereof is to reliably maintain an alignment of terminal fittings.

SUMMARY OF THE INVENTION

The invention is directed to a connector with a housing having a receptacle for receiving a mating connector. At least one terminal fitting is insertable into the housing and projects into the receptacle. A retainer is mountable into the receptacle, and has at least one insertion hole through which the terminal fitting is insertable. The retainer can be positioned in a first position where insertion and withdrawal of the terminal fitting into and from the housing is permitted. The retainer also can be moved to a second position where the retainer locks the terminal fitting. The connector also has a biasing member that can be pushed by the retainer for accumulating a resilient force.

The retainer is pushed when the mating connector is fitted into the receptacle, and the retainer, in turn, pushes the biasing member to accumulate resilient forces. The terminal fittings and mating terminal fittings are connected properly when the mating connector is fitted to a proper position. The terminal fittings are held straight and pass through the insertion holes in the retainer when the retainer is being pushed in. Therefore, connection can be smooth.

The mating connector may have to be detached from the connector. As a result, the resilient force of the biasing member returns the retainer and generates movement between the terminal fittings and the insertion holes. Thus, even if the terminal fittings are misaligned as the mating connector is detached, such a misalignment can be corrected automatically.

The retainer also functions as a moving plate to maintain the alignment of the terminal fittings.

The resilient force of the biasing member can push the mating connector back if the connecting operation is interrupted halfway. Thus, a partial connection is detected.

The terminal fittings preferably are male terminal fittings and each has a tab at its leading end. The male terminal fittings are insertable into the connector housing such that the tabs project through the respective insertion holes and into the receptacle.

The retainer preferably can be pushed from the first position to the second position that is more backward than the first position so that the retainer locks the terminal fittings so as not to come out. The retainer also can be moved to a third position more backward than the second position and reached while the terminal fittings are held locked.

The retainer and/or the housing may comprise locking means for locking the retainer in the first and/or second position. The locking means for locking the retainer in the second position is configured to permit a movement of the retainer towards the third position while the terminal fittings are held so as not to come out.

The retainer preferably is moved from the second position towards the third position by the insertion of the mating connector into the receptacle.

The connector preferably comprises a movable element that can be pushed by the retainer from the second position toward the third position, and a spring for biasing the movable element to move it forward.

The mating connector pushes the retainer from the second position to the third position and moves the movable element back against the biasing force of the spring to connect the connectors properly. The tabs of the male terminal fittings pass through the insertion holes of the retainer and are held substantially straight while the retainer is pushed to the third position. Thus, a smooth connection with the mating terminal fittings is ensured. The biasing force of the spring pushes the movable element and returns the retainer to the second position when the mating connector is detached from the connector. During this time, the tabs move back through the insertion holes, and any misalignment of the tabs is corrected automatically.

The retainer preferably comprises a deformation preventing portion that can enter deformation permitting spaces for locks that lock the male terminal fittings. The deformation preventing portion is retracted before the deformation permitting spaces when the retainer is at the first position, thereby permitting resilient deformation of the locks to permit insertion of the terminal fittings into the cavities of the housing. The preventing portion enters the front sides of the deformation permitting spaces when the retainer is at the second position, thereby preventing the resilient deformation of the locks and doubly locking the terminal fittings. Further, the preventing portion enters the back sides of the deformation permitting spaces when the retainer is at the third position so that the terminal fittings can be kept doubly locked.

The leading ends of the terminal fittings are in the insertion holes when the retainer is at the first position, and the mating connector is fitted into the receptacle when the retainer is at the first position.

Before the connection with the mating connector, the retainer is held at the first position, and the terminal fittings can be protected inside the retainer. Thus, external matter is not likely to strike against the terminal fittings before the connection.

Most preferably, the movable member selectively prevents the retainer from being moved from the second position to the first position.

The invention also relates to a method for connecting a connector with a mating connector. The method comprises inserting terminal fittings into the housing so that they project into a receptacle of a housing of the connector. The method continues by mounting a retainer into the receptacle so that the terminal fittings extend through the insertion holes. The retainer is adapted to lock the terminal fittings so as not to come out. The method proceeds by pushing the retainer back from a first position where the insertion and withdrawal of the terminal fittings into and from the housing are permitted, to a second position for preventing the inserted terminal fittings from coming out, and accumulating a resilient force in a biasing member by pushing the biasing member by the retainer.

The terminal fittings may male terminal fittings that have tabs at their leading ends and are inserted into the housing such that the tabs projects into the receptacle. The tabs are inserted through the respective insertion holes.

The method further comprises pushing the retainer from the first position to a second position more backward than the first position as seen in an insertion direction of the retainer and adapted to lock the terminal fittings so as not to come out and further pushing the retainer to a third position more backward than the second position and reached preferably while the terminal fittings are held so as not to come out.

The retainer preferably is locked in the first position and/or in the second position, wherein the retainer is moved towards the third position preferably while the terminal fittings are held so as not to come out.

Most preferably, the retainer is moved from the second position towards the third position by interaction with the mating connector being inserted into the receptacle.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
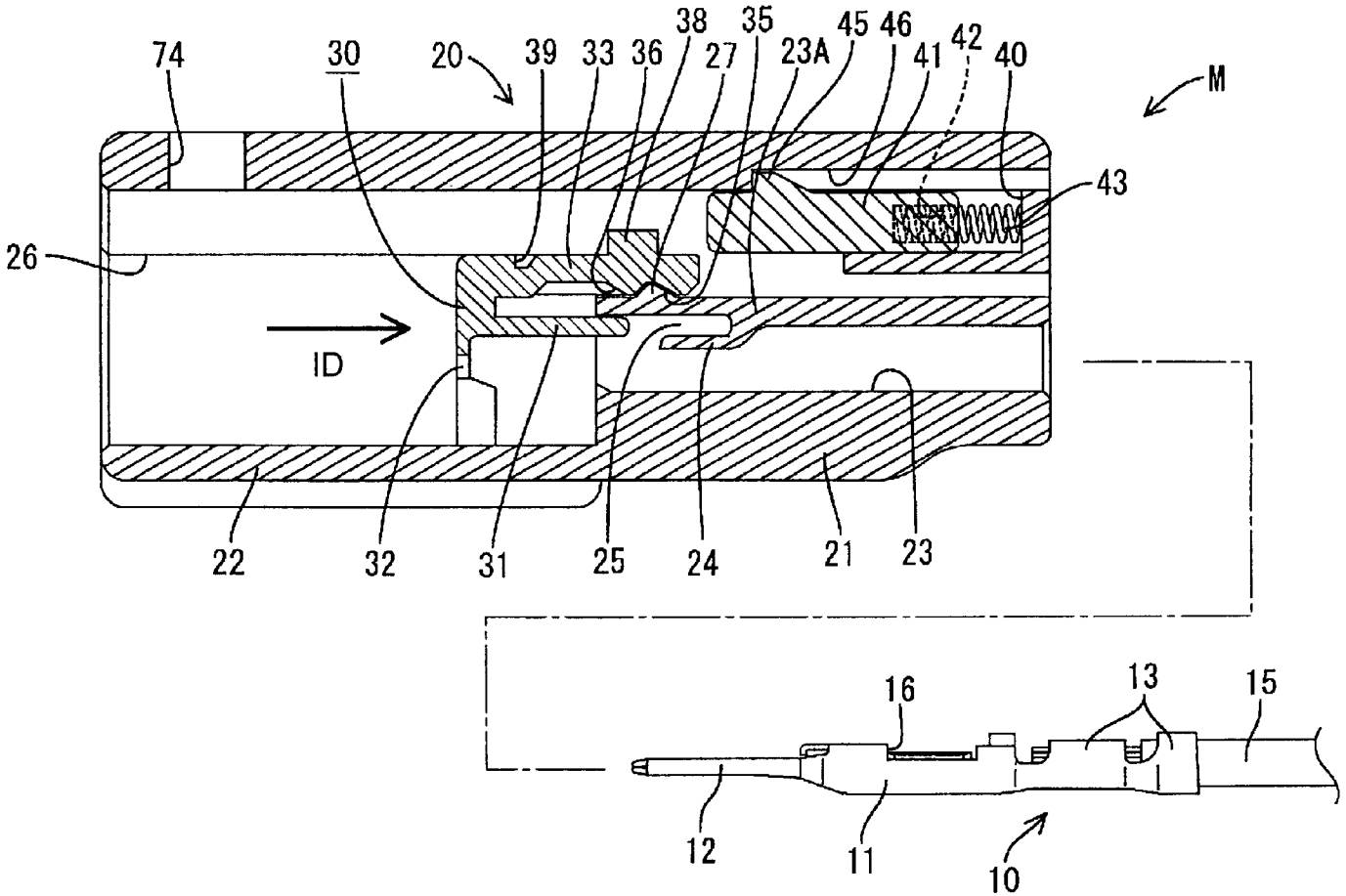
FIG. 1 is an exploded vertical section of a male connector.

The letter M in FIGS. 1 and 2–7 identifies a male connector according to the invention. The male connector M has a housing 20, male terminal fittings 10 accommodated in the housing 20, and a front-type retainer 30 for locking the male terminal fittings 10 in the housing 20.

Each male terminal fitting 10 is formed by stamping a highly conductive metallic plate and bending, embossing, cutting and/or folding the stamped plate. The male terminal fitting 10 has a rectangular tubular main body 11 and a tab 12 that projects at the leading end of the main body 11. Barrels 13 are formed at the rear of the male terminal fitting 10 and are configured for crimped, bent or folded connection with an end of a wire 15. A locking recess 16 is formed in the upper surface of the main body 11.

The male housing 20 has an elongate block-shaped main body 21 made e.g. of a synthetic resin. The main body 21 has a front end and a receptacle 22 extends into the front end. Cavities 23 extend in forward and backward directions and are arranged substantially side by side at the lower side in the main body 21. A resiliently deformable lock 24 is formed at a position of the ceiling surface of each cavity 23 near the receptacle 22 and is engageable with the locking recess 16 of the corresponding male terminal fitting 10. A deformation permitting space 25 is located above the lock 24 for accommodating the deformation of the lock 24.

Figure 2:
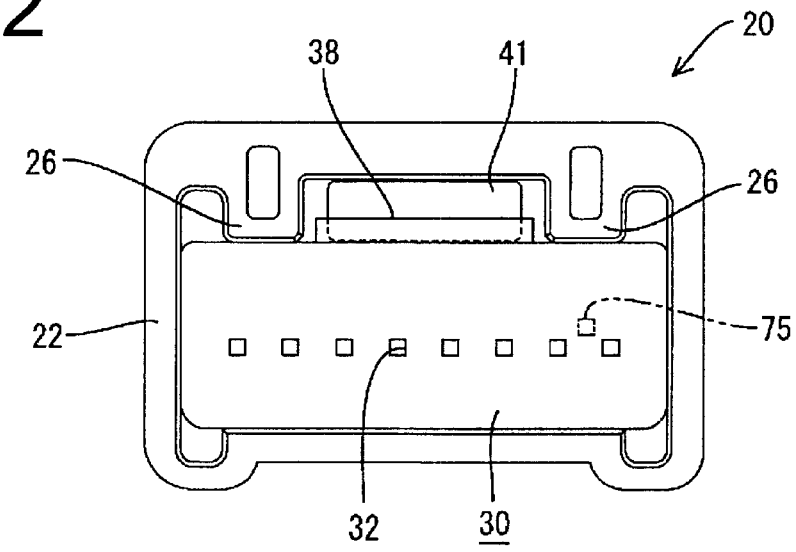
FIG. 2 is a front view of the male housing with a retainer therein.

The retainer 30 is fit in the receptacle 22 of the male housing 20 from the front. Specifically, as shown in FIG. 2, a pair of ribs 26 are formed on the ceiling surface of the receptacle 22 near the right and left sides, and the retainer 30 is insertable into an area defined between the bottom surface of the receptacle 22 and the ribs 26.

The retainer 30 is made e.g. of a synthetic resin and defines a wide thick plate. A preventing plate 31 projects from the front (right surface in FIG. 1) of the retainer 30 with respect to its inserting direction and is insertable into the deformation permitting spaces 25 of the respective locks 24. Insertion holes 32 are formed below the preventing plate 31 at positions corresponding to the respective cavities 23. The insertion holes 32 are dimensioned to slideably receive tabs 12 of the male terminal fittings 10.

A pushing portion 38 projects from the upper surface of the movable plate 33 of the retainer 30, and an engaging hole 39 is formed in the upper surface of the retainer 30.

A movable plate 33 projects forward at the upper end of the front of the retainer 30 with respect to its inserting direction ID and is slidable along ceiling walls 23A of the cavities 23. A locking projection 27 is on the upper surface of each ceiling wall 23A near the receptacle 22. On the other hand, a partial locking recess 35 is formed on the lower surface of the movable plate 33 of the retainer 30 near the leading end with respect to the inserting direction ID of the retainer 30, and is engageable with the locking projections 27. A full locking recess 36 is formed behind the partial locking recess 35 and also is engageable with the locking projection 27. The full locking recess 36 is elongated backward for an escaping purpose.

Figure 3:
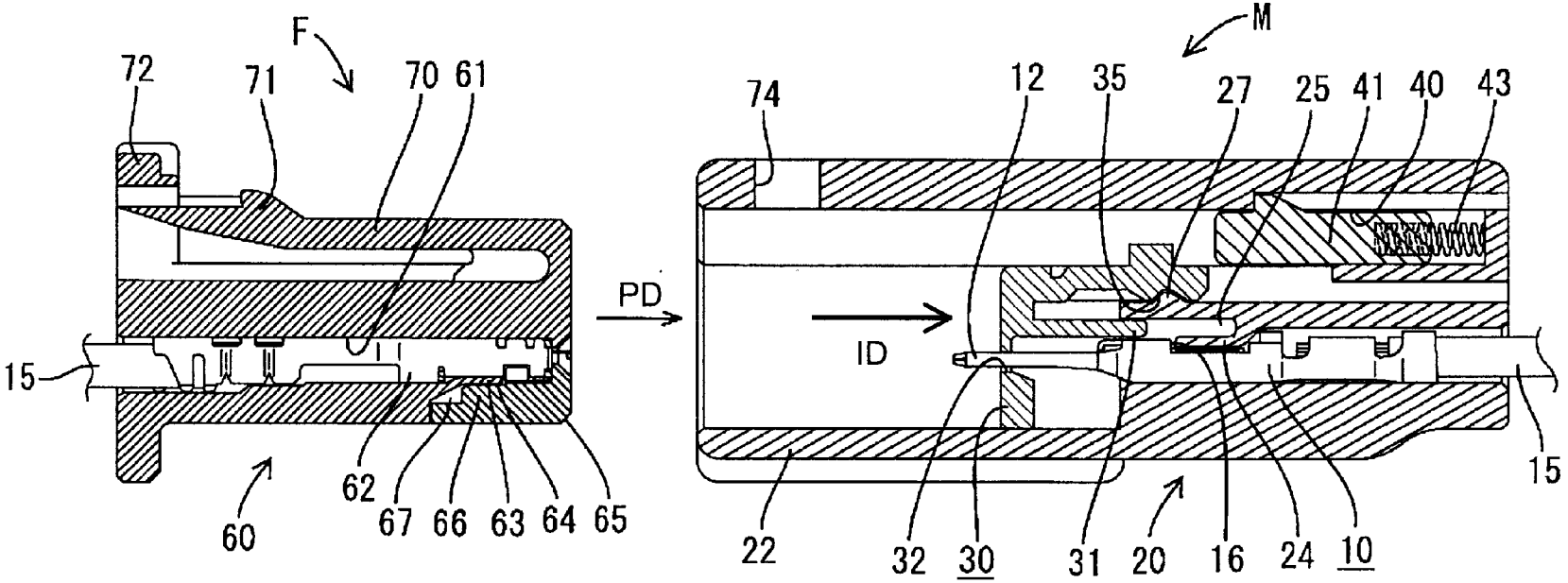
FIG. 3 is a vertical section showing a state before the male and female connectors are connected.

The retainer 30 can be held initially at a first or partial locking position in the receptacle 22, as shown in FIG. 3, by engaging the locking projections 27 with the partial locking recess 35. At this first position, the preventing plate 31 of the retainer 30 is retracted before the deformation permitting spaces 25 for the locks 24, as shown in FIG. 3, to permit resilient deformation of the locks 24 into the respective deformation permitting space 25. Thus, the male terminal fittings 10 can be inserted into and withdrawn from the cavities 23. The leading ends of the tabs 12 are inserted through the insertion holes 32 of the retainer 30 when the male terminal fittings 10 are inserted substantially to proper positions in the cavities 23.

Figure 4:
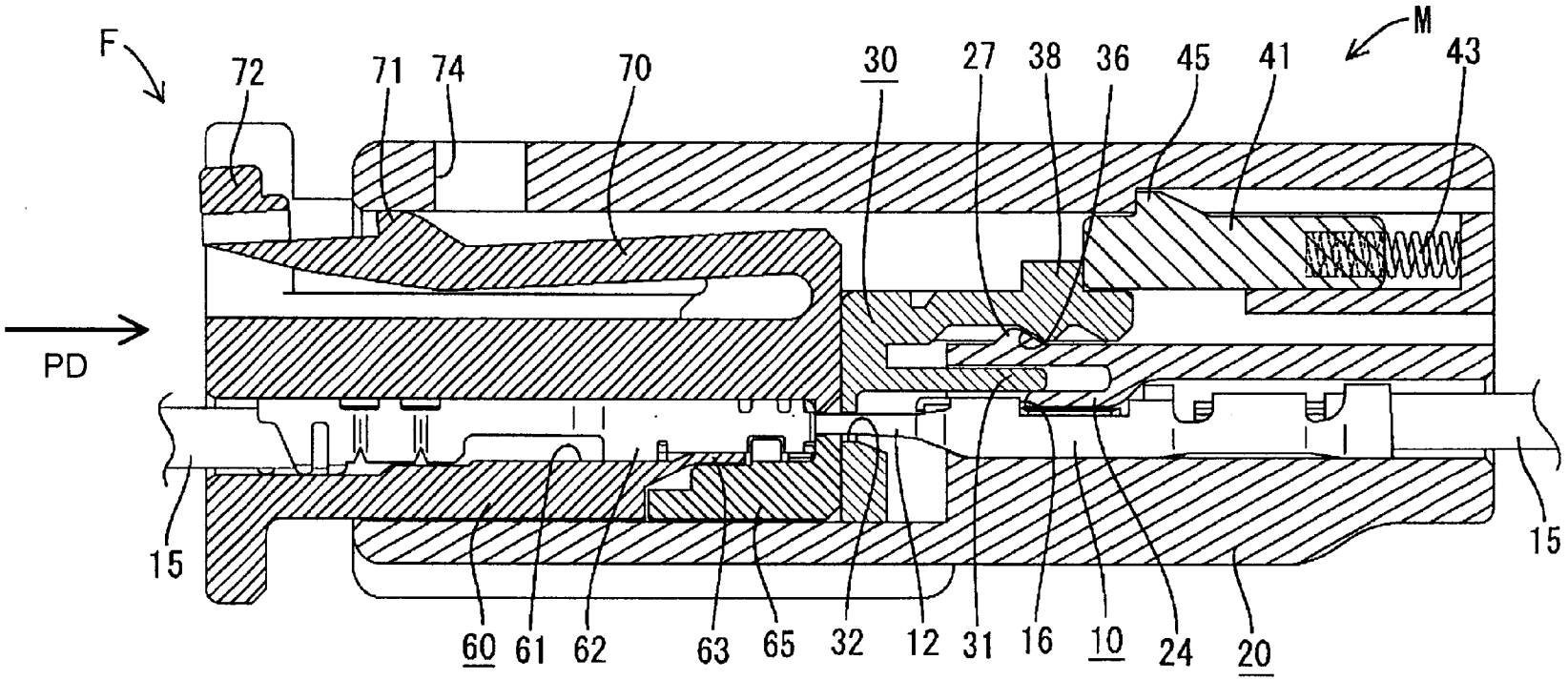
FIG. 4 is a vertical section showing a state where the male and female connectors are connected while the retainer is pushed to a second position.

The locking projections 27 engage the leading end of the full locking recess 36, as shown in FIG. 4, when the retainer 30 is pushed further back from the second position. Thus, the retainer 30 is held at a second or full locking position. At this second position, the preventing plate 31 of the retainer 30 projects into front sides of the deformation permitting spaces 25 for the locks 24 and prevents the resilient deformation of the locks 24. At this time, the front surface of the retainer 30, with respect to its inserting direction ID, is spaced away from the front surfaces of the cavities 23 by a specified distance D.

Figure 5:
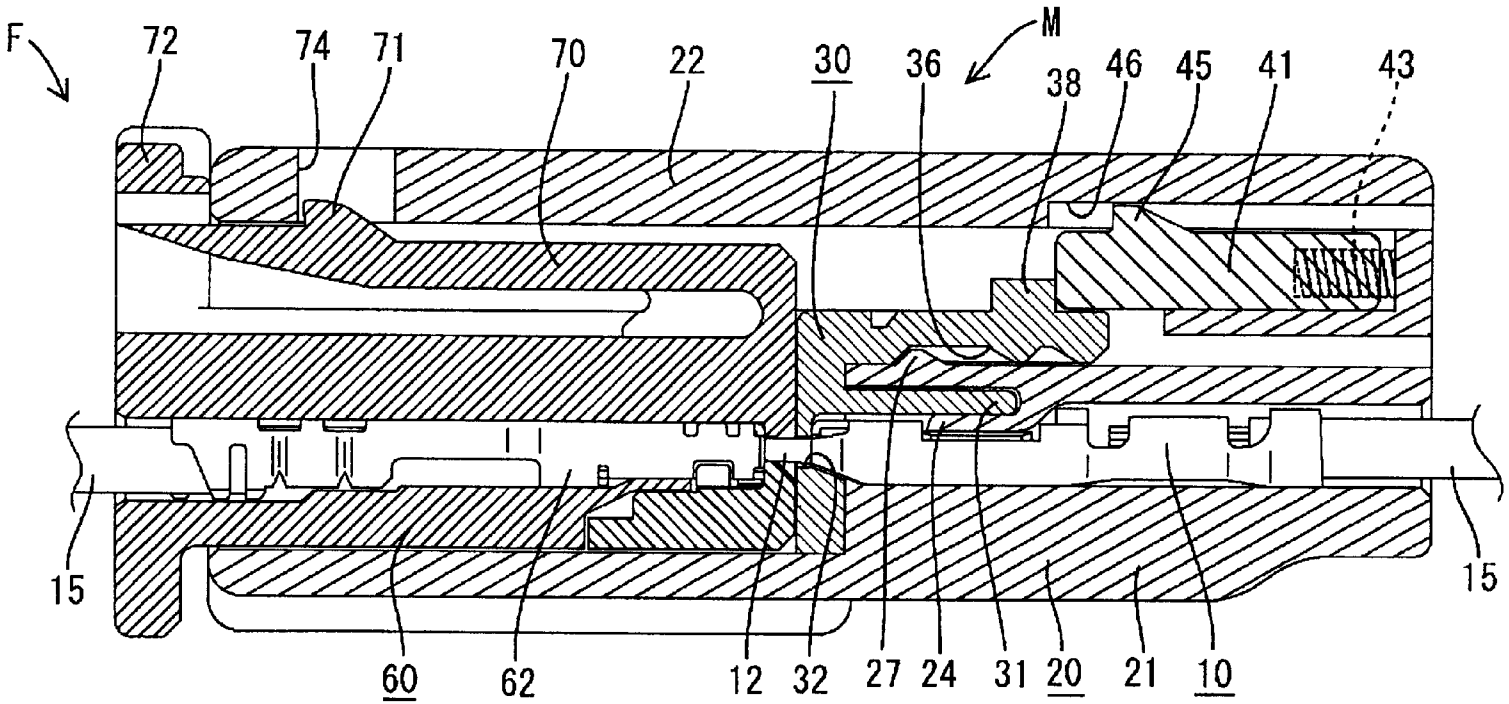
FIG. 5 is a vertical section showing the male and female connectors are properly connected with each other.

The retainer 30 can be pushed further to a third or pushed-in position where the retainer 30 contacts the front surfaces of the cavities 23 while letting the locking projections 27 escape backward in the full locking recess 36, as shown in FIG. 5. At this stage, the preventing plate 31 cannot be inserted further backward in the deformation permitting spaces 25.

An accommodating chamber 40 opens forward at the upper side of the main body 21, and a movable element 41 is disposed in the accommodating chamber 40 for sliding movement in forward and backward directions. The movable element 41 is biased forward by a compression coil spring 43 mounted between a spring mount hole 42 in the rear surface of the movable element 41 and the back surface of the accommodating chamber 40. The movable element 41 is stopped by contact of a projection 45 on the upper surface of the movable element 41 with the front edge of a locking groove 46 formed in the ceiling surface of the accommodating chamber 40.

A mating female connector F is shown in FIG. 3, and includes a female housing 60 that can fit in the receptacle 22 of the male housing 20. Cavities 61 are formed substantially side-by-side in the female housing 60, similar to the cavities 23. Female terminal fittings 62 secured to ends of wires 15 are inserted from behind to proper positions in the cavities 61, and locks 63 engage with locking recesses 64 of the female terminal fittings 62. Thus, the female terminal fittings 62 are locked partially. A retainer 65 can be pushed to a full locking position. A preventing portion 66 projects into the deformation permitting spaces 67 for the locks 63, thereby preventing deformation of the locks 63. As a result, the female terminal fittings 62 are locked doubly.

A lock arm 70 is provided on the upper surface of the female housing 60 and a projection 71 is formed on the lock arm 70. The projection 71 fits into a lock hole 74 in the upper surface of the receptacle 22 when the female housing 60 is fit substantially to a proper position in the receptacle 22 of the male housing 20. As a result, the male and female housings 20, 60 are locked in their properly connected state.

The retainer 30 is held at the first position, as shown in FIG. 1, and the male terminal fittings 10 are inserted from behind into the respective cavities 23. The preventing plate 31 is retracted before the deformation permitting spaces 25 for the locks 24 when the retainer 30 is at the first position. Thus, the male terminal fittings 10 can be pushed in and deform the locks 24. The locks 24 are restored resiliently when the male terminal fittings 10 are inserted and engage the locking recesses 16 to partly lock the male terminal fittings 10, as shown in FIG. 3. At this stage, the leading ends of the tabs 12 of the male terminal fittings 10 project through the insertion holes 32 of the retainer 30 and into the receptacle 22.

The female terminal fittings 62 are inserted into the cavities 61 of the female housing 60 and are locked partially by the locks 63, as shown in FIG. 3. Subsequently, the retainer 65 is pushed to the full locking position to lock the female terminal fittings 62 redundantly.

The retainer 65 then is pushed to the full locking position, and the female housing 60 is fitted in direction PD of in FIG. 3 into the receptacle 22 of the male housing 20 with the retainer 30 at the first position.

Movement of the female housing 60 in the direction PD urges the projection 71 into the front wall of the lock hole 74, and hence deforms the lock arm 70. The front surface of the female housing 60 then starts pushing the retainer 30 of the male housing 20. As a result, the pushing portion 38 of the retainer 30 contacts the front surface of the movable element 41, as shown in FIG. 4, and the locks 27 engage the front end of the full locking recess 36 to hold the retainer 30 temporarily at the second position. At this time, the preventing plate 31 of the retainer 30 projects into the fronts of the deformation permitting spaces 25 for the locks 24. As a result, resilient deformation of the locks 24 is prevented and the male terminal fittings 10 are locked redundantly. During this time, the tabs 12 of the male terminal fittings 10 are inserted into the cavities 61 of the female housing 60 from the front and start contacting contact pieces of the female terminal fittings 62.

The female housing 60 continues to be pushed in the direction PD, and the retainer 30 is pushed in the direction ID that is substantially parallel to the pushing direction PD of the female connector F. The pushing compresses the compression coil spring 43 and moves the movable element 41 back. The retainer 30 is pushed to the third position where it substantially contacts the front surfaces of the cavities 23. The lock arm 70 is restored so that the projection 71 fits in the lock hole 74 to lock the male and female housings 20, 60 in their properly connected state, as shown in FIG. 5. Simultaneously, the corresponding male and female terminal fittings 10, 62 are connected properly.

The movement of the retainer 30 urges the preventing plate 31 further back in the deformation permitting spaces 25 to lock the male terminal fittings 10 redundantly. Additionally, the movement of the retainer 30 guides the tabs 12 of the male terminal fittings 10 closely through the insertion holes 32 of the retainer 30. Thus, the tabs 12 are held straight and are connected smoothly with the mating female terminal fittings 62. The base ends of the tabs 12 eventually enter the insertion holes 32 of the retainer 30.

Frictional resistance between the male and female terminal fittings 10, 62 and connection resistance between the male and female housings 20, 60 increase at a final stage of the connection. Thus, the connecting operation may be stopped with the housings 20, 60 left only partly connected. However, the resilient restoring force of the compression coil spring 43 returns the movable element 41 to the advanced position and pushes the retainer 30 back to the second position if the connecting operation is interrupted before the housings are locked together. As a result, the female housing 60 is pushed back, and the partial connection of the housings 10, 60 can be detected. Then, the female housing 60 may be pushed again into the receptacle 22.

Figure 6:
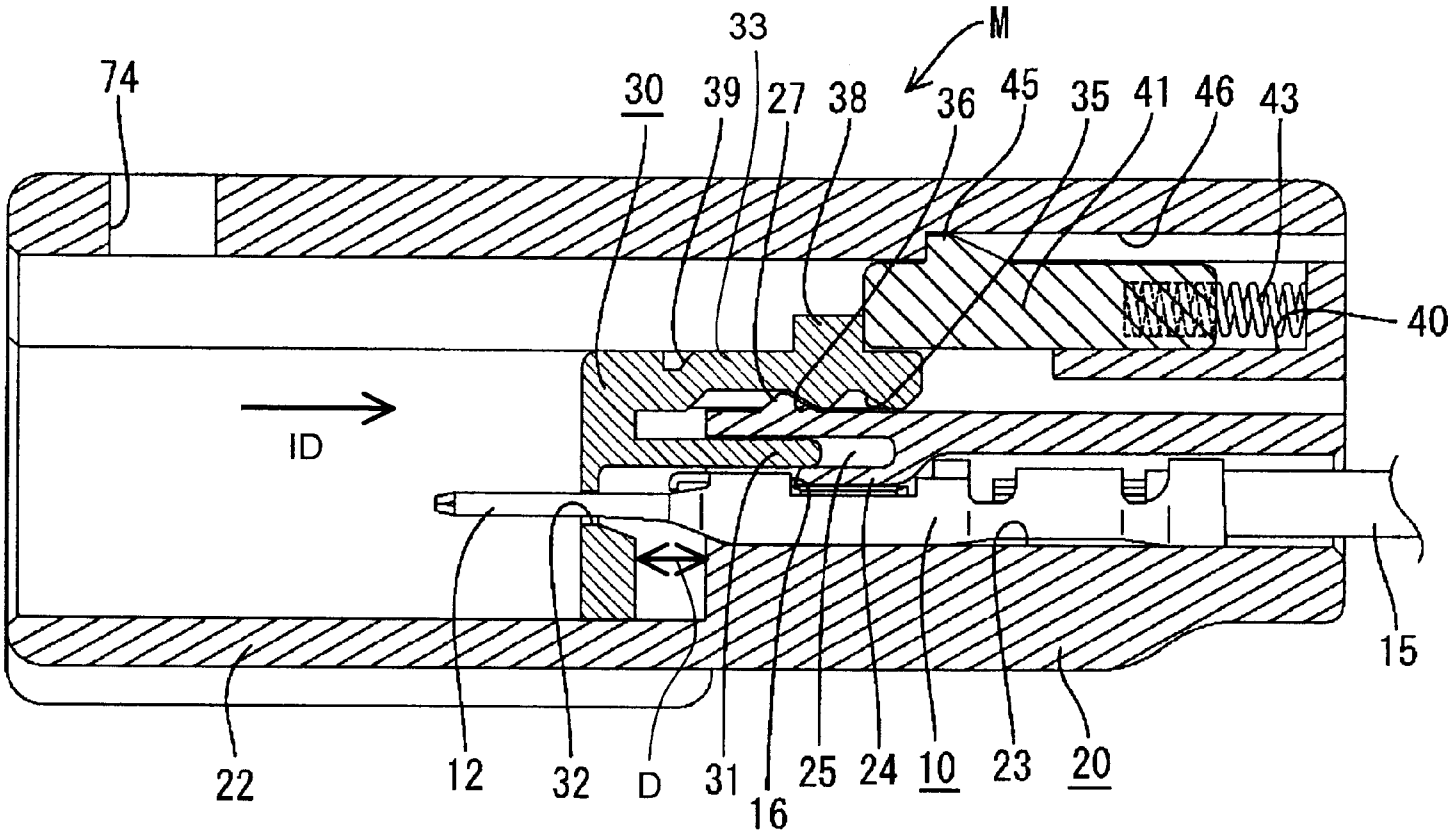
FIG. 6 is a vertical section of the male connector in such a state where the female connector is detached therefrom and the retainer is returned to the second position.

The male and female housings 20, 60 may be detached by pressing an operable portion 72 to deform the lock arm 70, thereby effecting unlocking and permitting withdrawal of the female housing 60 from the receptacle 22. A concern exists that the forcible withdrawal of the female housing 60 could bend or misalign the tabs 12 of the male terminal fittings 10. However, a force that pushes the retainer 30 is canceled when the female housing 60 is withdrawn from the receptacle 22, and the resilient restoring force of the compression coil spring 43 acts on the movable element 41 to push the retainer back toward the second position, as shown in FIG. 6. During this time, the tabs 12 of the male terminal fittings 10 move back through the insertion holes 32 of the retainer 30. Thus, any misalignment of the tabs 12 that may exist can be corrected, and the male and female housings 20, 60 can be connected smoothly the next time.

Figure 7:
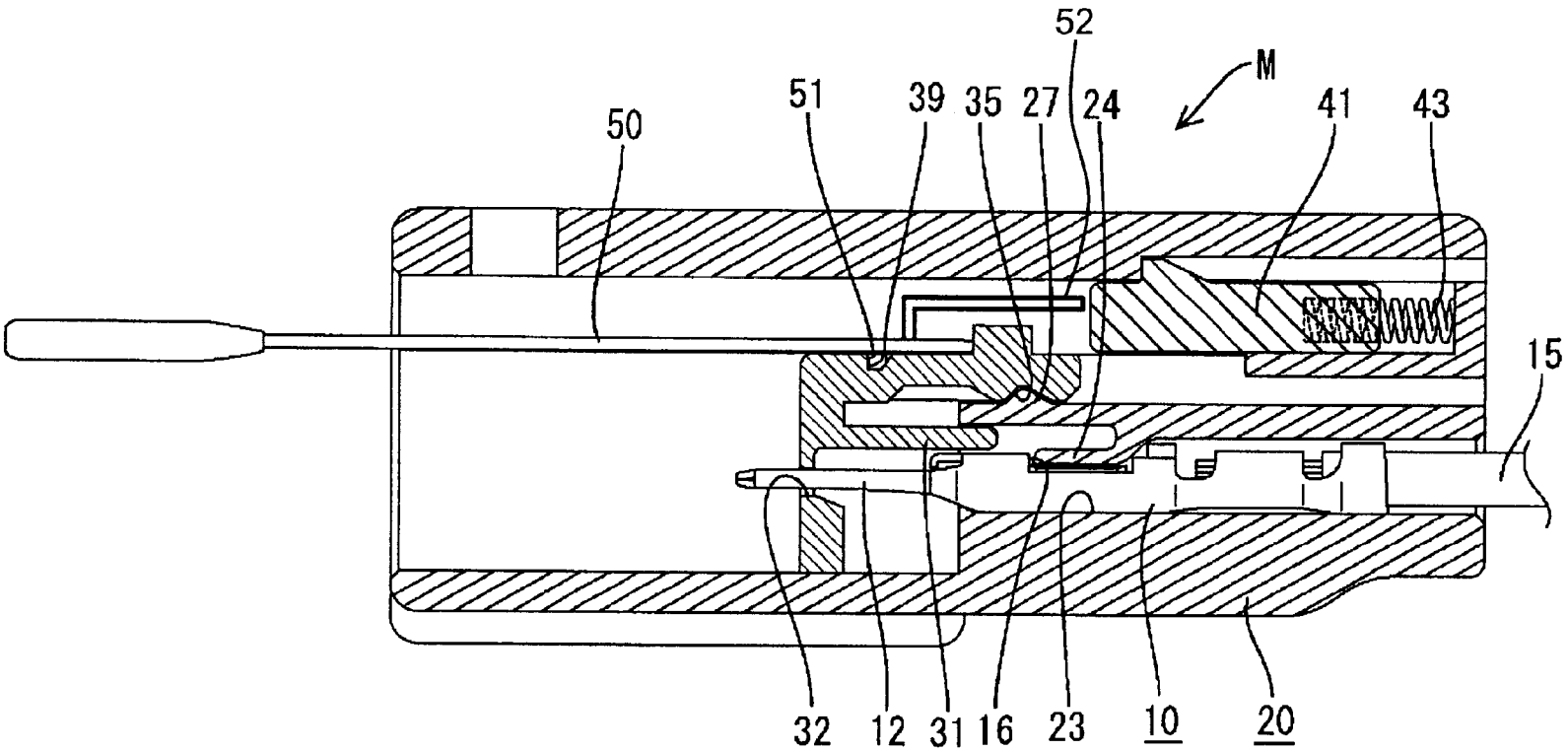
FIG. 7 is a vertical section of the male connector in such a state where the retainer is returned to a partial locking position.

The male terminal fitting 10 is detached from the male housing 20 by inserting a jig 50 from the front side of the receptacle 22, as shown in FIG. 7. The jig 50 has a hook 51 that engages the engaging hole 39 in the upper surface of the retainer 30. The jig 50 also has a pusher 52 that pushes the movable element 41 back relative to the movable plate 33. Thus, the movable element 41 does not overlap longitudinally with the movable plate 33, and the movable plate 33 can deflect so that the locking projection 27 can move from the full locking recess 36 to the partial locking recess 35. The jig 50 then can be pulled to return the retainer 30 to the first position. The preventing plate 31 escapes from the deformation permitting spaces 25 when the retainer 30 is returned to the first position. Thereafter, the lock 24 is deformed forcibly to cancel partial locking, and the wire 15 can be pulled to withdraw the male terminal fitting 10 rearwardly from the cavity 23.

Each lock 24 may have a transverse unlocking bulge and the retainer 30 may be formed with jig insertion openings 75 (only one is shown in phantom in FIG. 2) to expose the corresponding unlocking bulges to the outside. A jig is inserted through the jig insertion opening 75 to press the unlocking bulge, thereby resiliently deforming the lock 24 and canceling the locking effect.

The retainer 30 also functions as a moving plate, and the alignment of the tabs 12 of the male terminal fittings 10 can be maintained by a simple construction.

The retainer 30 is held at the first position before connection with the female connector F, and the tabs 12 of the male terminal fittings 10 are protected inside the retainer 30. Thus, external matter is unable to strike against and damage the tabs 12 of the male terminal fittings 10.

The retainer 30 is biased in a returning direction opposed to the inserting direction ID by the resilient restoring force of the compression coil spring 43 mounted in the rear surface of the movable element 41. Thus, the retainer 30 is returned to the second position when the female housing 60 is withdrawn from the receptacle 22 to correct misalignment of the tabs 12 of the male terminal fittings 10 automatically. The retainer 30 is stopped by the interaction of the locking recess 35 and the locking projection 27. Additionally, the movable element 41 prevents the movable plate 33 from passing over the locking projection 27, and the movable plate 33 cannot move further back.

The connection of the male and female housings 20, 60 can be detected utilizing the biasing force of the compression coil spring 43.

The retainer 30 is biased in its returning direction by the compression coil spring 43 when the male and female housings 20, 60 are locked in their properly connected states. Accordingly, the projection 71 of the lock arm 70 is pressed against the front surface of the lock hole 74 to achieve strong locking.

Figure 8:
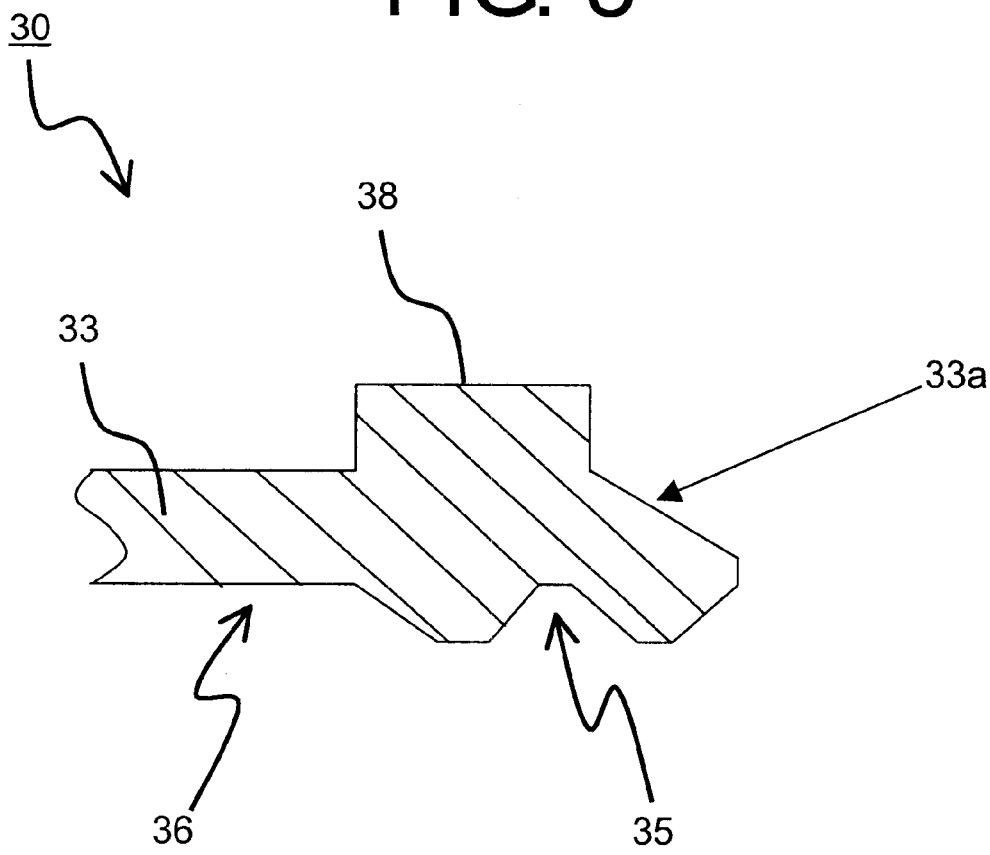
FIG. 8 is a sectional view of an alternate retainer in accordance with the subject invention.
Figure 9:
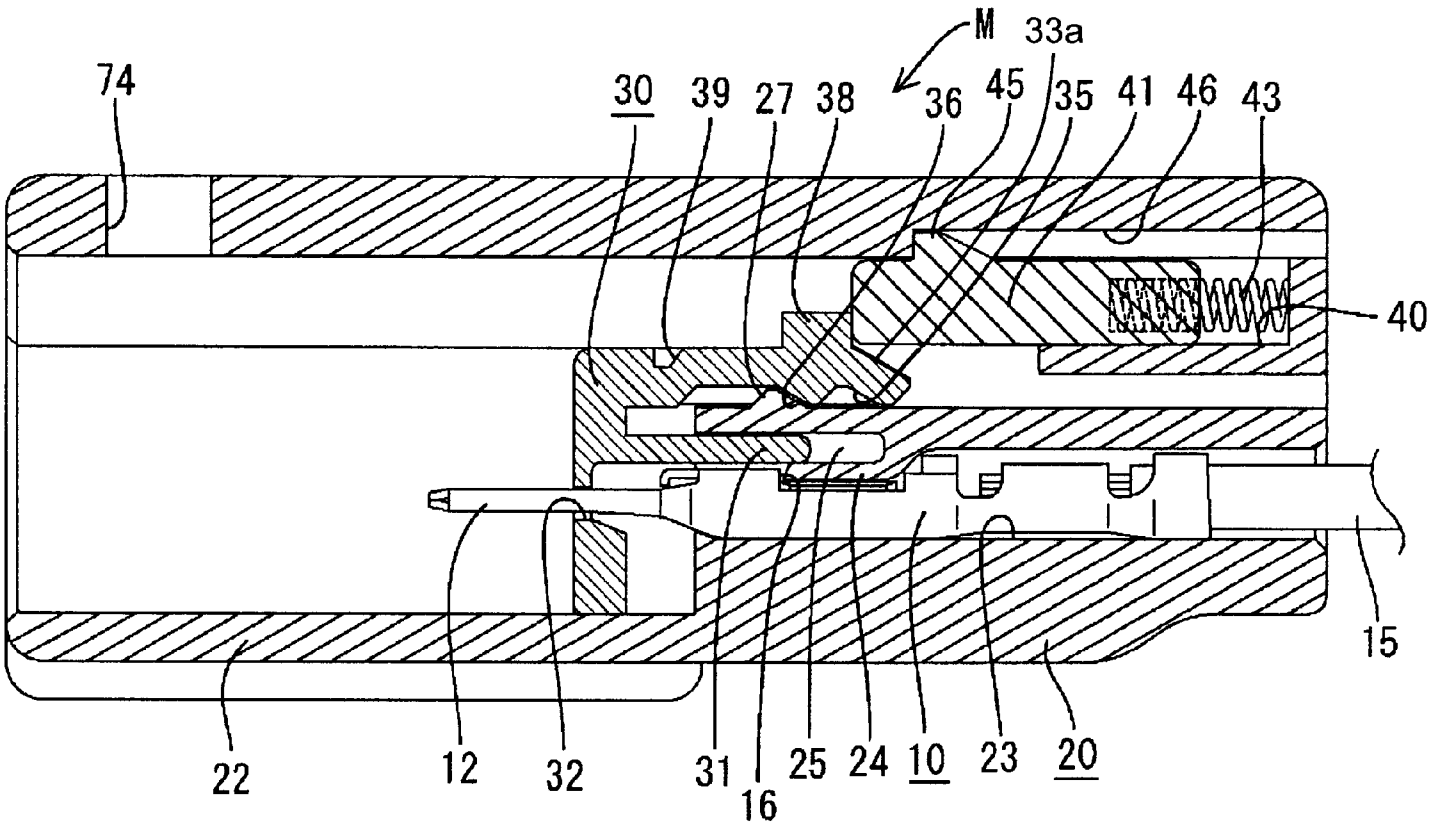
FIG. 9 is a cross-sectional view similar to FIG. 6, but showing the alternate retainer.

FIGS. 8 and 9 show an alternate embodiment of the retainer 30 that is identical in most respects to the retainer 30 described and illustrated above. However, the retainer 30 of FIGS. 8 and 9 has a movable plate 33 with a slanted surface 33*a* that extends from the pushing portion 38 downwardly to the front end of the movable plate 33. The slanted surface 33*a* ensures that the front end of the movable plate 33 does not contact the front end of the movable element 41 in a way that would prevent or impede the engagement between the pushing portion 38 and the movable element 41. Thus, connection is assured of being smoother. Furthermore, disconnection also can be easier and a jig 50 without a pusher 52 can be employed for disconnection.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the retainer is pushed from the first position to the second position as the housing is connected with the mating housing in the foregoing embodiment, the retainer may be pushed to the second position before the connection with the mating housing.

A leaf spring, a resilient rod or other member may be used as a biasing or spring member for biasing the movable element forward.

What is claimed is:

1. A connector (M), comprising:

a housing (20) having a receptacle (22) into which a mating connector (F) is fittable, terminal fittings (10) insertable into the housing (20) and projecting into the receptacle (22), a retainer (30) mounted in the receptacle (22) and having insertion holes (32) through which the terminal fittings (10) are insertable, the retainer (30) being adapted to lock the terminal fittings (10) in the housing (20), wherein the retainer (30) can be pushed in an insertion direction (ID) from a first position (FIGS. 1; 3; 7) where insertion and withdrawal of the terminal fittings (10) into and from the housing (20) are permitted to a second position (FIGS. 4, 6) where the terminal fittings (10) are prevented from coming out, and a biasing member (43) for accumulating a resilient force by being pushed by the retainer (30) towards the first position (FIGS. 1; 3; 7).

2. The connector of claim 1, wherein the terminal fittings (10) are male terminal fittings (10) each having a tab (12) at a leading end thereof, the male terminal fittings (10) being insertable into the housing (20) such that the tabs (12) project into the receptacle (22), wherein the tabs (12) are inserted through the respective insertion holes (32).

3. The connector of claim 2, wherein the retainer (30) can be pushed from the second position (FIGS. 4; 6) to a third position (FIG. 5) more backward than the second locking position (FIGS. 4; 6) and reached while the terminal fittings (10) are held so as not to come out.

4. The connector of claim 3, wherein the retainer (30) and the housing (20) comprise locking means (27, 35, 36) for locking the retainer (30) in the first position (FIGS. 1; 3; 7) and in the second position (FIGS. 4; 6).

5. The connector of claim 4, wherein the locking means (27, 35) for locking the retainer (30) in the second locking position (FIGS. 4; 6) is configured to permit movement of the retainer (30) towards the third position (FIG. 5) while the terminal fittings (10) are held so as not to come out.

6. The connector of claim 5, wherein the retainer (30) is configured for engagement by the mating connector (F) inserted into the receptacle (22) for moving the retainer (30) from the second locking position (FIGS. 4; 6) towards the third position (FIG. 5).

7. The connector of claim 1, further comprising a movable element (41) configured for being pushed by the retainer (30) as the retainer (30) is being moved from the second locking position (FIGS. 4; 6) toward the third position (FIG. 5), wherein the biasing member (43) biases the movable element (41) in a direction opposed to the insertion direction (ID) of the retainer (30).

8. The connector of claim 7, wherein the movable member (41) selectively prevents the retainer (30) from being moved from the second position (FIGS. 4; 6) to the first position (FIGS. 1; 3; 7).

9. The connector of claim 1, wherein leading ends of the terminal fittings (10) are in the insertion holes (32) with the retainer (30) at the first position (FIGS. 1; 3; 7), and the mating connector (M) is fittable into the receptacle (22) with the retainer (30) at the first position (FIGS. 1; 3; 7).

10. The connector of claim 1, wherein the housing (20) comprises locks (24) for partially locking the terminal fittings (10) in the housing (20) and deformation permitting spaces (25) adjacent the locks (24), the retainer (30) comprising a deformation preventing portion (31) configured for entering the deformation permitting spaces (25) when the retainer (30) is in the second position and configured for being retracted before the deformation permitting spaces (25) when the retainer (30) is at the first position (FIGS. 1; 3; 7).

11. The connector of claim 10, wherein the deformation preventing portion (31) enters front sides of the deformation permitting spaces (25) when the retainer (30) is at the locking position (FIGS. 4; 6) and enters back sides of the deformation permitting spaces (25) when the retainer (30) is at the third position (FIG. 5).

12. A method for connecting a connector (M) with a mating connector (F), comprising the following steps:

mounting a retainer (30) at a first position (FIGS. 1; 3; 7) in a receptacle (22) of a housing (20) of the connector (M);

inserting terminal fittings (10) into the housing (20), such that leading ends of the terminal fittings (10) project through insertion holes (32) of the retainer (30) and into the receptacle (22) of the housing (20);

pushing the retainer (30) back from the first position (FIGS. 1; 3; 7) to a second position (FIGS. 4; 6) where the retainer (30) prevents the terminal fittings (10) from coming out; and accumulating a resilient force in a biasing member (43) by pushing the biasing member (43) by the pushed retainer (30).

13. The method of claim 12, wherein the terminal fittings (10) are male terminal fittings (10) each having a tab (12) at its leading end and are inserted into the connector housing (20) such that the tab (12) at least partly projects into the receptacle (22), wherein the tabs (12) are inserted through the respective insertion holes (32).

14. The method of claim 12, further comprising pushing the retainer (30) to a third position (FIG. 5) located more backward than the second position (FIGS. 4; 6) and reached while the terminal fittings (10) are locked.

15. The method of claim 14, further comprising locking the retainer (30) in the first position (FIGS. 1; 3; 7) and in the second position (FIGS. 4; 6).

16. The method of claim 14, wherein the retainer (30) is moved from the second position (FIGS. 4; 6) towards the third position (FIG. 5) by the interaction with the mating connector (F) being inserted into the receptacle (22).

17. A connector (M), comprising:

a housing (20) having opposite front and rear ends and a receptacle (22) extending into the front end for receiving a mating connector (F);

terminal fittings (10) insertable into the housing (20) and projecting forwardly into the receptacle (22);

a retainer (30) movable between a front position (FIGS. 1; 3; 7) and at least one rear position (FIGS. 4; 5; 6) in the receptacle (22), the retainer (30) having insertion holes (32) closely surrounding the terminal fittings (10) and slideable relative to the terminal fittings (10) as the retainer (30) is moved between the front position (FIGS. 1; 3; 7) and the rear position (FIGS. 4; 5; 6), the retainer (30) being adapted to lock the terminal fittings (10) in the housing (20) when the retainer (30) is in the rear position (FIGS. 4; 5; 6); and a biasing means (43) for pushing the retainer (30) towards the front position (FIGS. 1; 3; 7) when the mating connector (F) is being removed from the receptacle (22), whereby the sliding movement of the retainer (30) along the terminal fittings (10) corrects any misalignments of the terminal fittings (10) each time the mating connector (F) is inserted in and removed from the receptacle (22).

18. The connector of claim 17, further comprising means (27; 35) for locking the retainer in the front position (FIGS. 1; 3; 7) and means (27; 36) for locking the retainer (20) in the rear position (FIGS. 4; 5; 6).

19. The connector of claim 17, wherein the biasing means (43) is configured for accumulating biasing forces as the retainer (20) is moved to the rear position (FIGS. 3; 4; 5).

* * * * *